US006732832B2

(12) United States Patent
Chan

(10) Patent No.: US 6,732,832 B2
(45) Date of Patent: May 11, 2004

(54) SPEAKER DAMPER

(76) Inventor: Yen-Chen Chan, No. 120, Min An East Road, Hsin Chuang City, Taipei Hsien (TW)

( * ) Notice: Subject to any disclaimer, the term of this patent is extended or adjusted under 35 U.S.C. 154(b) by 0 days.

(21) Appl. No.: 09/993,119

(22) Filed: Nov. 14, 2001

(65) Prior Publication Data

US 2003/0089549 A1 May 15, 2003

(51) Int. Cl.[7] ..... H04R 25/00
(52) U.S. Cl. ..... 181/166; 181/157
(58) Field of Search ..... 181/166, 167, 181/1, 69, 173, 20, 7, 208; 381/409

(56) References Cited

U.S. PATENT DOCUMENTS 5,125,473 A * 6/1992 Sakamoto et al. ..... 181/116
5,191,697 A * 3/1993 Sakamoto et al. ..... 29/594
6,269,167 B1 * 7/2001 Mango et al. ..... 381/410
6,597,798 B1 * 7/2003 Nakazono et al. ..... 381/410

* cited by examiner

*Primary Examiner*—Robert Nappi
*Assistant Examiner*—David Warren
(74) *Attorney, Agent, or Firm*—Ostrolenk, Faber, Gerb & Soffen, LLP

(57) ABSTRACT

A speaker damper comprises a damper casing and a metallic whisker, wherein the damper casing is substantially a woven pad formed as a circular wafer with corrugated sections, while the metallic whisker is substantially a conductive wire intermittently penetrated and buried in the damper casing. A fastening string is provided to tie the metallic whisker intermittently and hold it steadily to the damper casing without incurring the so-called repetitious jump-rope phenomenon during vibration of the later.

7 Claims, 5 Drawing Sheets

SPEAKER DAMPER

FIELD OF THE INVENTION

This invention relates generally to a speaker, particularly to a speaker damper.

BACKGROUND OF THE INVENTION

As a speaker damper is usually inserted between the casing and the drum paper of speaker, and a metallic whisker for transmitting signals from the casing terminal to the drum paper is generally laid across the damper. Therefore, the suspended metallic whisker is liable to be ruptured in dismounting a speaker or in vibrating the drum paper, or it may be entrapped in repetitious jump-rope phenomenon during power output.

In view of abovesaid defects, a proposal disclosed is to weave the metallic whisker in a fabric damper before the later is pressed and molded. By so doing, the fabrication process is more complicated with a higher cost though, the rupture of whisker can be avoided however unmerited in the following points nevertheless:

(1) Complicated process and high cost;

(2) Possible change of a whisker's diameter when molding, which may incur poor transmission quality or result in rupture;

(3) Difficult to view any rupture of a whisker woven in the fabric damper; and (4) A shortened lifetime of molds when the damper is molded together with the whisker.

SUMMARY OF THE INVENTION

The primary object of this invention is to provide a speaker damper composed of a damper casing and a metallic whisker, wherein the damper casing is substantially a woven pad formed as a circular wafer with corrugated sections, while the metallic whisker is substantially a conductive wire intermittently penetrated and buried in the damper casing; and a fastening string is provided to tie the metallic whisker intermittently and hold it steadily to the damper casing without incurring the so-called repetitious jump-rope phenomenon during vibration of the later.

The merits of this invention may be summarized as the following:

(1) Rupture of the metallic whisker could be significantly avoided.

(2) In the event of any rupture, it can be viewed and repaired easily.

(3) Jump-rope phenomenon could be thoroughly eliminated.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
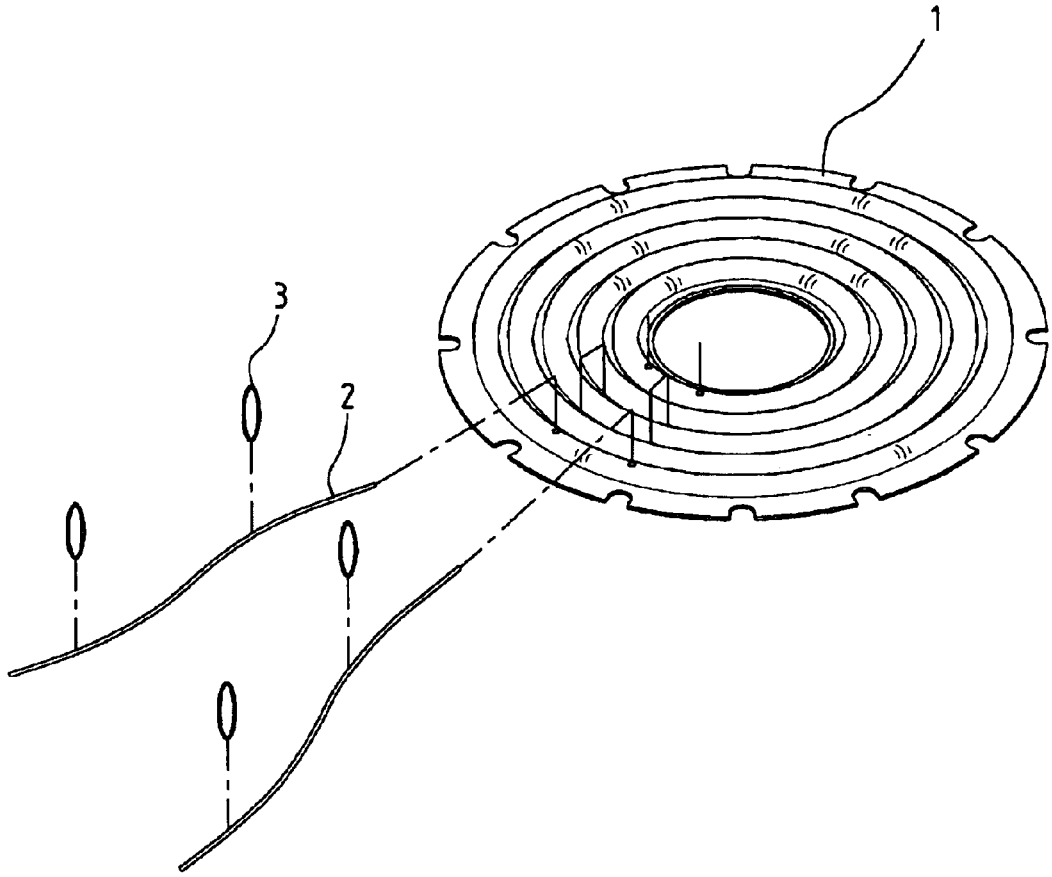
FIG. 1 is an exploded view of an embodiment of this invention.
Figure 2:
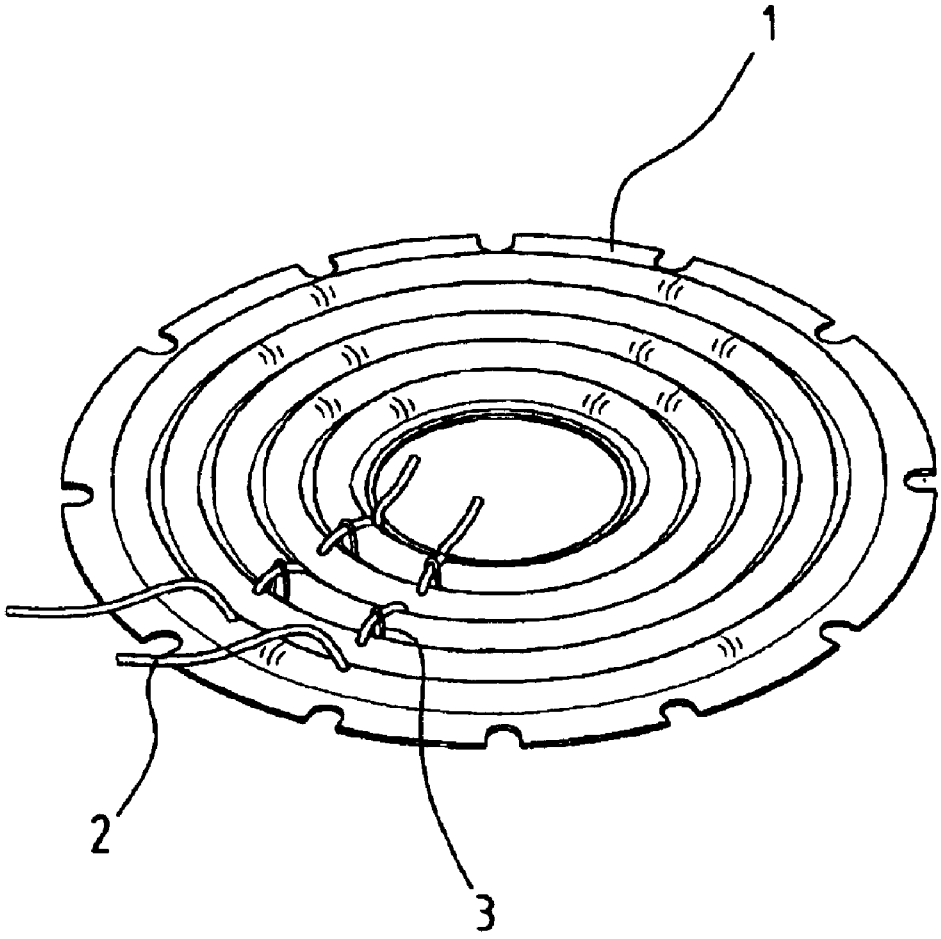
FIG. 2 is a perspective view of this embodiment in three dimensions.

As indicated in the exploded view of FIG. 1 and an the perspective view of FIG. 2, a speaker damper of this invention mainly comprises a damper casing 1 and a metallic whisker 2. The damper casing 1 is substantially a woven pad formed as a circular wafer with corrugated sections. The metallic whisker 2 is a conductive wire penetratingly disposed at a proper position of the top rim of the damper casing 1. Moreover, a fastening string 3 is provided to tie the metallic whisker 2 intermittently between the damper casing 1 and the metallic whisker 2 for positioning the whisker 2 to the damper casing 1 steadily without incurring the so-called repetitious jump-rope phenomenon during vibration of the damper casing 1.

Figure 3:
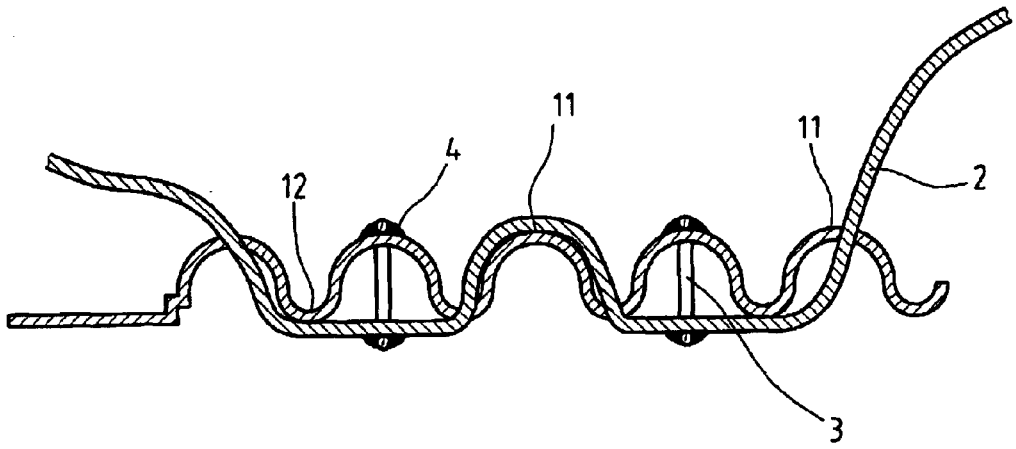
FIG. 3 is a cutaway sectional view of this invention embodiment (1)
Figure 4:
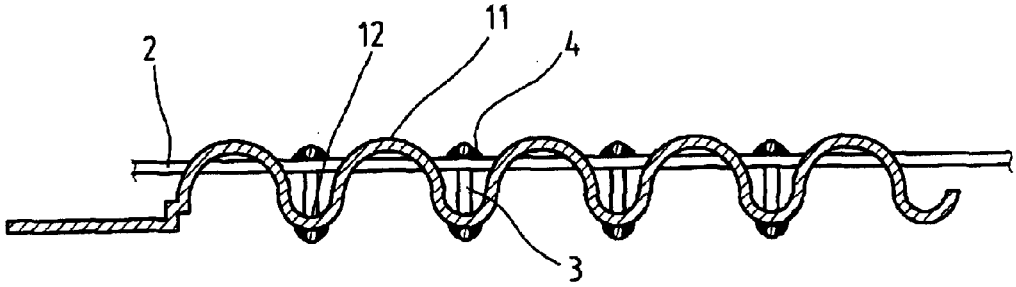
FIG. 4 is another cutaway sectional view of this invention embodiment (2)

Referring to FIGS. 3 and 4—sectional view (1) and view (2) of this invention—the corrugated damper casing 1 is composed of a plurality of peak segments 11 and valley segments 12 in view of its cutaway section. The intermittently buried metallic whisker 2 is extended toward the center of the damper casing 1 and held by the fastening string 3 either intermittently along the peak segments 11 or consecutively along the valley segments 12, and every juncture of the fastening string 3 and the damper casing or the fastening string 3 and the metallic whisker 2 is fixed with a fixing binder 4 so that the metallic whisker 2 is stably fixed to the damper casing 1 without incurring the jump-rope phenomenon.

Figure 5:
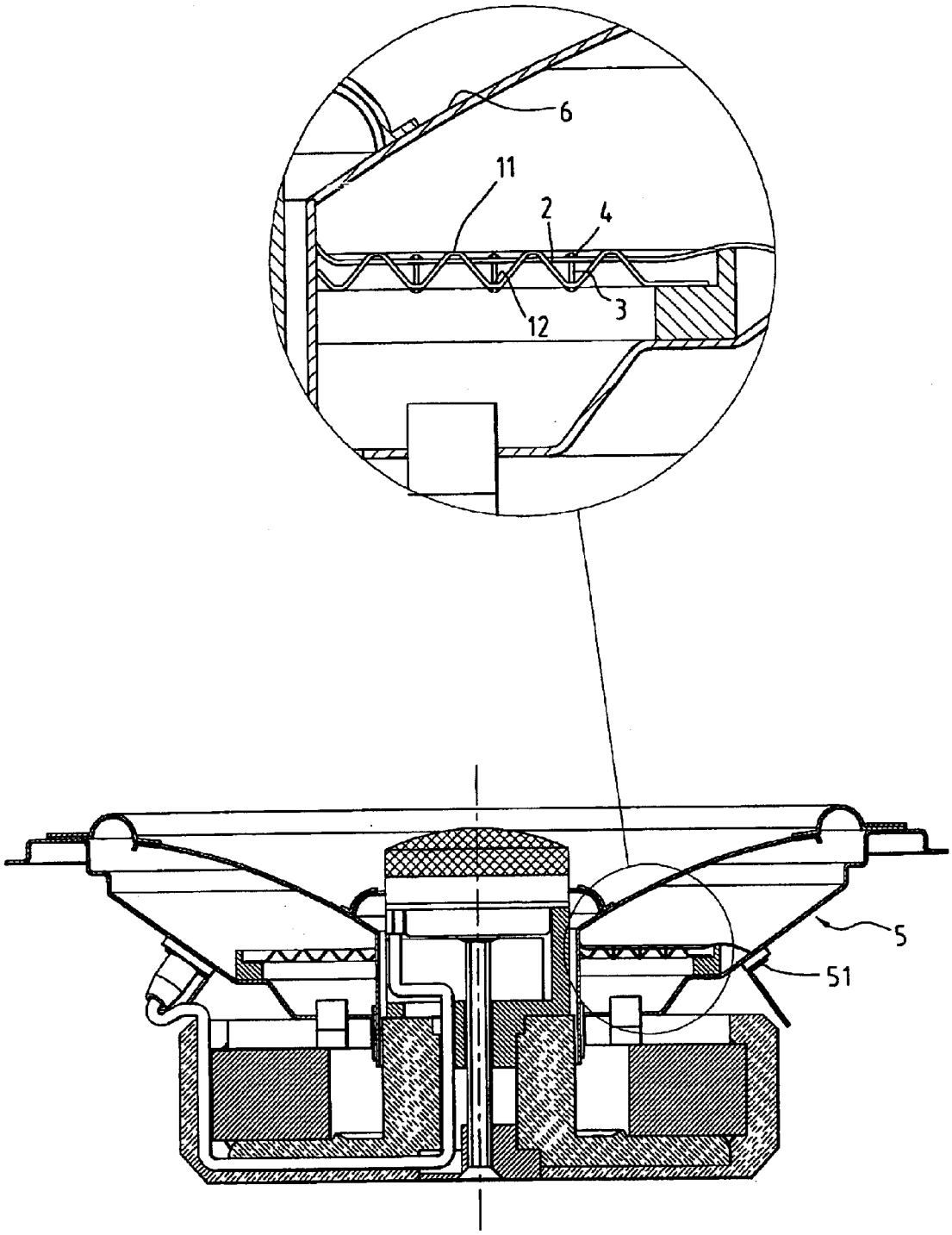
FIG. 5 is a cutaway sectional view showing an a speaker including the disclosed embodiment of this invention.

According to an embodiment of this invention shown in FIG. 5, the damper casing 1 is arranged between a speaker casing 5 and a drum paper 6. One end of the metallic whisker 2 is connected to a signal terminal 51 of the speaker casing 5, then is penetrated through the damper casing 1 and fixed with the fastening string 3. Finally, the other end of the metallic whisker 2 is extended to reach a proper position at the circumference of the drum paper 6 such that signals can be transmitted from the signal terminal 51 to the drum paper 6 effectively via the metallic whisker 2.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A speaker damper, comprising a damper casing and a metallic whisker, wherein the damper casing is a woven pad formed as a circular wafer with corrugated sections which are corrugated so as to have peak segments and valley segments; and the metallic whisker intermittently penetrates through the damper casing between a first surface and a second surface of said damper casing, an intermittent air space between the whisker and the damper casing, and a fastening string attaching the whisker at the air space location.

2. The speaker damper according to claim 1, wherein a fixing binder is applied to secure said fastening string to said at least one of said peak and valley segments.

3. The speaker damper according to claim 2, wherein said fixing binder is also applied to secure said fastening string to said metallic whisker.

4. The speaker damper according to claim 1, wherein said metallic whisker is held by respective said fastening strings to a plurality of said peak segments.

5. The speaker damper according to claim 4, wherein a fixing binder is applied to secure each of said fastening strings to the corresponding said peak segment and to said metallic whisker.

6. The speaker damper according to claim 1, wherein said metallic whisker is held by respective said fastening strings to a plurality of said valley segments.

7. The speaker damper according to claim 6, wherein a fixing binder is applied to secure each of said fastening strings to the corresponding said valley segment and to said metallic whisker.

* * * * *